US007128539B2

(12) United States Patent
Anderson et al.

(10) Patent No.: US 7,128,539 B2
(45) Date of Patent: Oct. 31, 2006

(54) METHOD FOR IMPROVED CLEANING OF A PUMPING SYSTEM

(75) Inventors: Troy Allen Anderson, Vernon, NJ (US); Joseph W. Kieffer, Sparta, NJ (US); Sandor Peter Veres, Mahwah, NJ (US)

(73) Assignee: Titan Tool, Inc, Oakland, NJ (US)

( * ) Notice: Subject to any disclaimer, the term of this patent is extended or adjusted under 35 U.S.C. 154(b) by 0 days.

(21) Appl. No.: 10/159,789

(22) Filed: May 31, 2002

(65) Prior Publication Data

US 2003/0223876 A1 Dec. 4, 2003

(51) Int. Cl.
*F04B 49/08* (2006.01)

(52) U.S. Cl. ..... 417/43; 417/53; 137/22.1; 137/22.11; 137/22.18; 137/38; 137/34; 137/22.12

(58) Field of Classification Search ..... 417/53, 417/43; 134/22.1, 22.11, 22.12, 22.18, 23, 134/26, 34, 38, 42, 103.1, 108, 168 R, 168 C, 134/169 R, 169 C, 95.1, 95.3, 18, 188
See application file for complete search history.

(56) References Cited

U.S. PATENT DOCUMENTS 2,682,273 A * 6/1954 Roach ..... 134/102
2,818,076 A * 12/1957 Erling ..... 134/102
3,655,294 A * 4/1972 Thatcher ..... 415/68
3,882,407 A * 5/1975 Arsem ..... 327/560
3,904,431 A * 9/1975 Dinerman ..... 134/88
4,238,073 A * 12/1980 Liska ..... 239/127
4,361,282 A * 11/1982 DiVito ..... 239/381
4,480,967 A * 11/1984 Schulze ..... 417/368
4,588,357 A * 5/1986 McGraw et al. ..... 417/34
4,874,002 A * 10/1989 Sundholm ..... 134/111
5,035,580 A * 7/1991 Simonette ..... 417/34
5,174,723 A * 12/1992 Groger et al. ..... 417/26
5,304,041 A * 4/1994 Fontanazzi et al. ..... 417/53
5,322,571 A 6/1994 Plummer et al. ..... 134/22.12
5,401,324 A * 3/1995 Huddas ..... 134/21
5,699,817 A 12/1997 Bankert et al. ..... 134/102.2
5,937,875 A * 8/1999 Nygren ..... 134/22.11
6,090,222 A * 7/2000 Ivey et al. ..... 134/21
6,098,573 A * 8/2000 Oyagi et al. ..... 122/401
6,210,492 B1 * 4/2001 Wilson, III ..... 134/18
6,520,190 B1 * 2/2003 Thompson et al. ..... 134/22.18
6,659,114 B1 * 12/2003 Bigott ..... 134/95.3
2002/0107501 A1 * 8/2002 Smith et al. ..... 604/500

* cited by examiner

*Primary Examiner*—Tae Jun Kim
*Assistant Examiner*—Emmanuel Sayoc
(74) *Attorney, Agent, or Firm*—Katten Muchin Rosenman LLP

(57) ABSTRACT

Improved method for cleaning a pump, fluid hose, and spray gun is provided by, for example, repeatedly changing the flow rate of the cleaning fluid pumped through the system to generate turbulence or increased turbulence and increased frictional resistance for enhanced cleaning action. A pressure control can cyclically vary the speed of the pump motor and pump connected thereto to generate the turbulence. The pumping cycle can alternate between a first and second power level and at a desired time interval for each speed. With a suitable solvent as the pumped fluid, the turbulence that is generated by the cyclical pumping action causes an increase in the scrubbing action of the solvent to quickly loosen residual material in the fluid passageways.

19 Claims, 4 Drawing Sheets

METHOD FOR IMPROVED CLEANING OF A PUMPING SYSTEM

BRIEF SUMMARY OF THE INVENTION

Paint sprayers, hoses and spray guns require a thorough cleaning after each use. Failure to do so allows material to build up inside the paint passageways that will eventually degrade the performance of the equipment. Once painting is completed, the operator flushes a solvent through the paint pump, hose and gun to remove any residual paint. The solvent circulates through the unit and flushes the paint out into a waste container. The present invention overcomes the disadvantages of the prior art by providing an improved process for cleaning a spray paint system that performs more efficiently than prior art systems.

The flow rate of a positive-displacement pump is essentially proportional to pump speed. In a preferred embodiment of the invention, a pressure controller cyclically varies the electric power that is applied to the pump motor. Power cycling causes the speed of the motor and pump connected thereto to vary, and doing this in regular intervals produces, for example, an alternating pattern of increasing and decreasing flow rates causing an oscillation to occur in the fluid stream to generate turbulence or increased turbulence in the pumped fluid. (irregular intervals or random speed changes could be used as well to create this effect.) The pumping cycle can alternate between first and second power levels at a desired time interval for each power level. With a suitable solvent as the pumped fluid, the turbulence or increased turbulence that is generated by the cyclical pumping action causes an increase in the scrubbing action of the solvent to quickly loosen residual paint in the paint line and thus enhance the cleaning of the paint spray system.

Rather than to have the pump cycle between first and second power levels, the power to the pump can be changing in a variety of other arrangements, including without limitation via stepped power changes (e.g., increased power, further increased, reduced power, further reduced power) or even random power changes.

It is therefore an object of this invention to provide an improved system for cleaning a high-pressure paint sprayer.

It is a further object of this invention to provide a system for cleaning a high-pressure paint sprayer that performs reliably and cleans in less time and with less solvent than conventional systems.

These and other objects and advantages of the invention will become apparent from the following description and the accompanying drawings.

DETAILED DESCRIPTION OF PREFERRED EMBODIMENTS OF THE INVENTION

Figure 1:
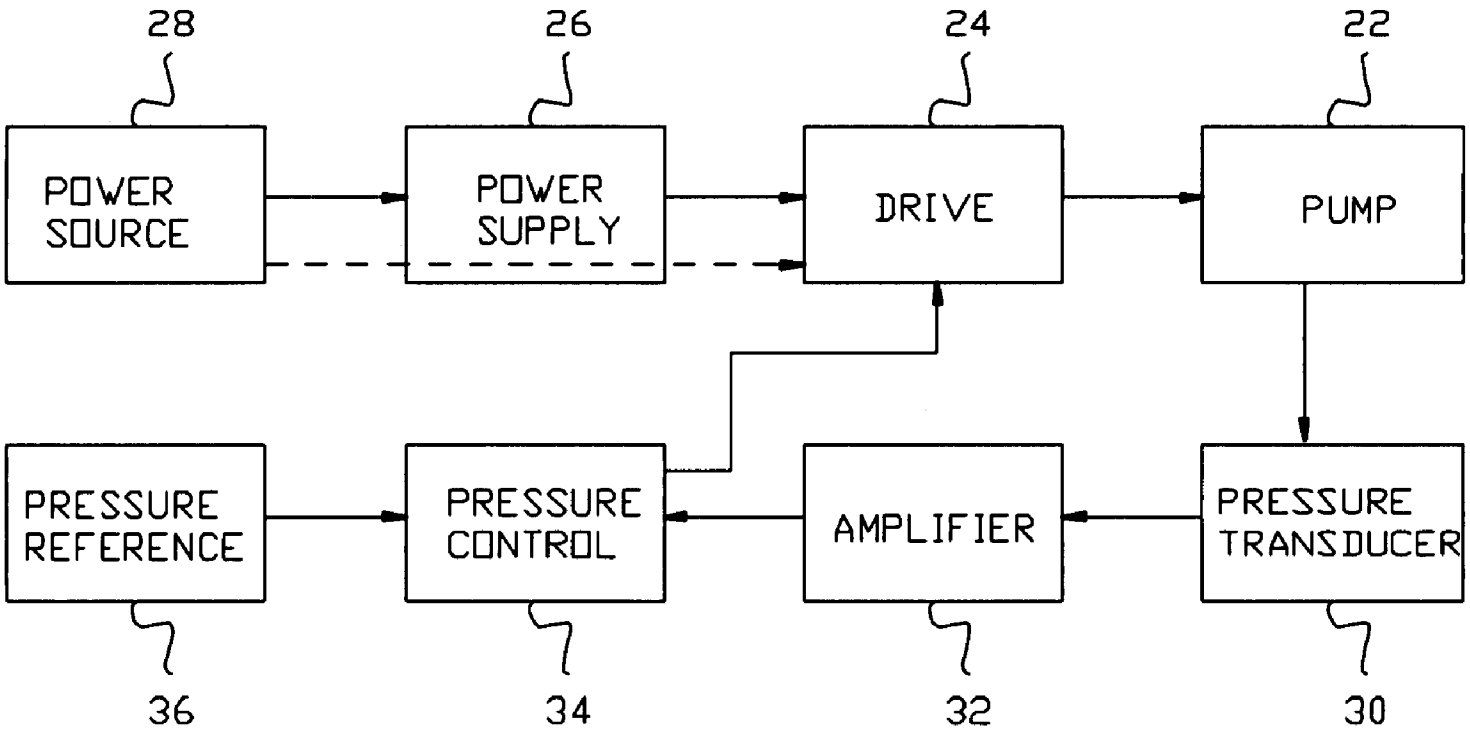
FIG. 1 is a simplified block diagram of the system of the present invention.

FIG. 1 is a simplified block diagram of the system 20 of one embodiment of the present invention. System 20 preferably has a pump 22 powered by a drive 24 that is energized by a power supply 26 receiving its power from a power source 28. A pressure transducer 30 at the outlet of pump 22 delivers a signal proportional to the actual pressure via an amplifier 32 to a pressure control 34, which also receives a desired pressure signal from a pressure reference 36. Pressure control 34 delivers a signal on line 38 to control the drive 24 to operate pump 22 to achieve the desired flow rate in the fluid system. Pressure control 34 includes a microprocessor having memory and a stored control program, which includes the cleaning routine of the present invention. A typical pressure range of pressure control 34, for example, is 0 to 3300 PSI.

Figure 2:
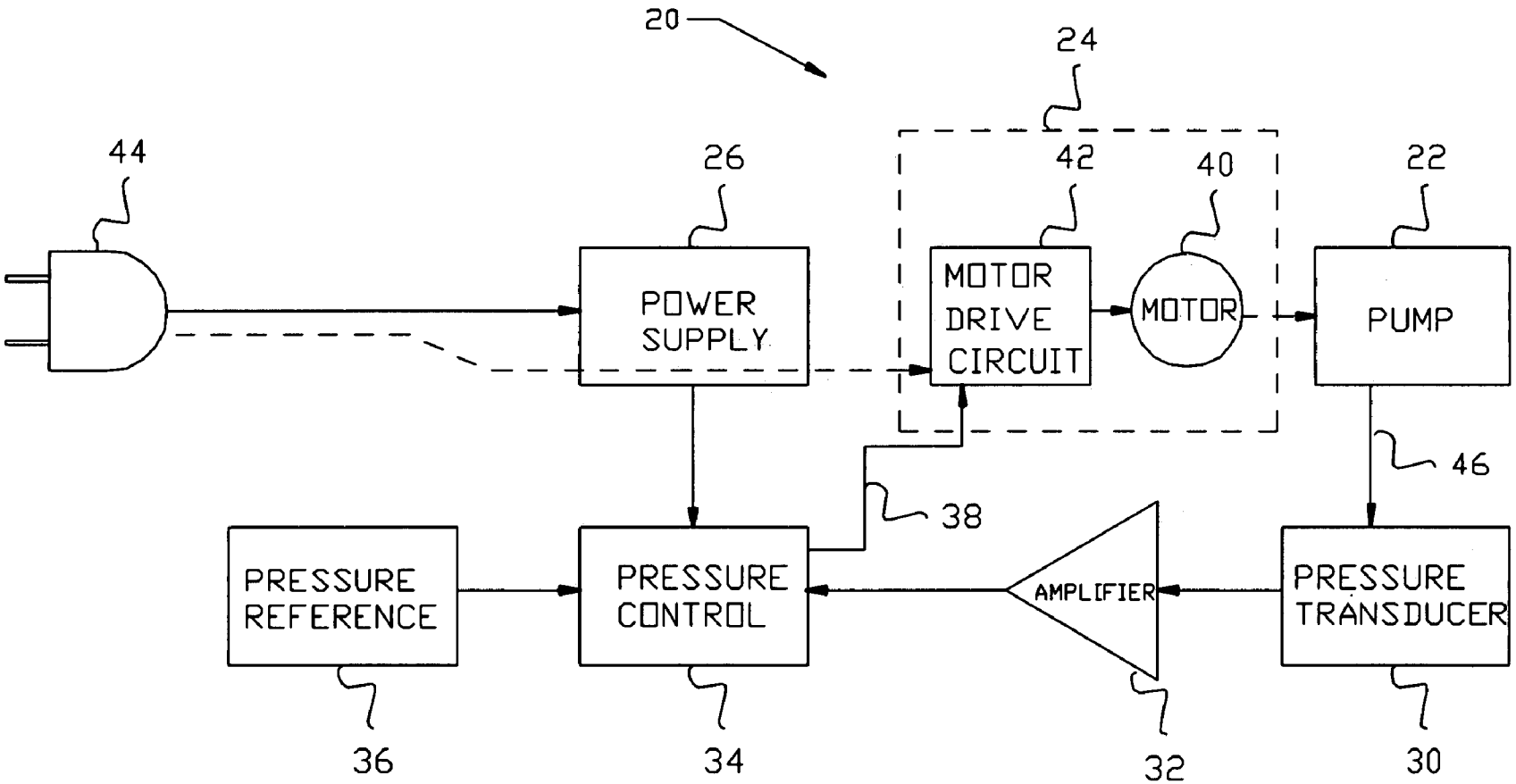
FIG. 2 is a more detailed block diagram of the system corresponding to FIG. 1.

FIG. 2 is a more detailed block diagram of the system 20 of the present invention. Pressure reference 36, typically a potentiometer, provides a user adjustable reference point or set point for the desired pressure at the outlet 46 of pump 22. A conventional strain gauge bridge in pressure transducer 30 measures the actual pressure at pump outlet 46. Amplifier 32 enhances the output signal from pressure transducer 30, which is compared to the desired pressure signal from pressure reference 36 after analog values are converted to digital values by pressure control 34.

In a preferred embodiment of the present invention, drive 24 is comprised of an electric motor 40 and motor drive circuit 42 receiving power from an electric power source 44, typically standard 120 or 240 VAC electric power as is commonly available. In the practice of this invention, pressure control 34 varies power to the motor 40 from the drive circuit 42 by adjusting the duty cycle of the drive circuitry 42. The drive circuitry can be a conventional design. It is to be understood, however, that the electric motor 40 may be replaced by a gasoline engine and clutch or another suitable prime mover to drive pump 22.

Figure 3:
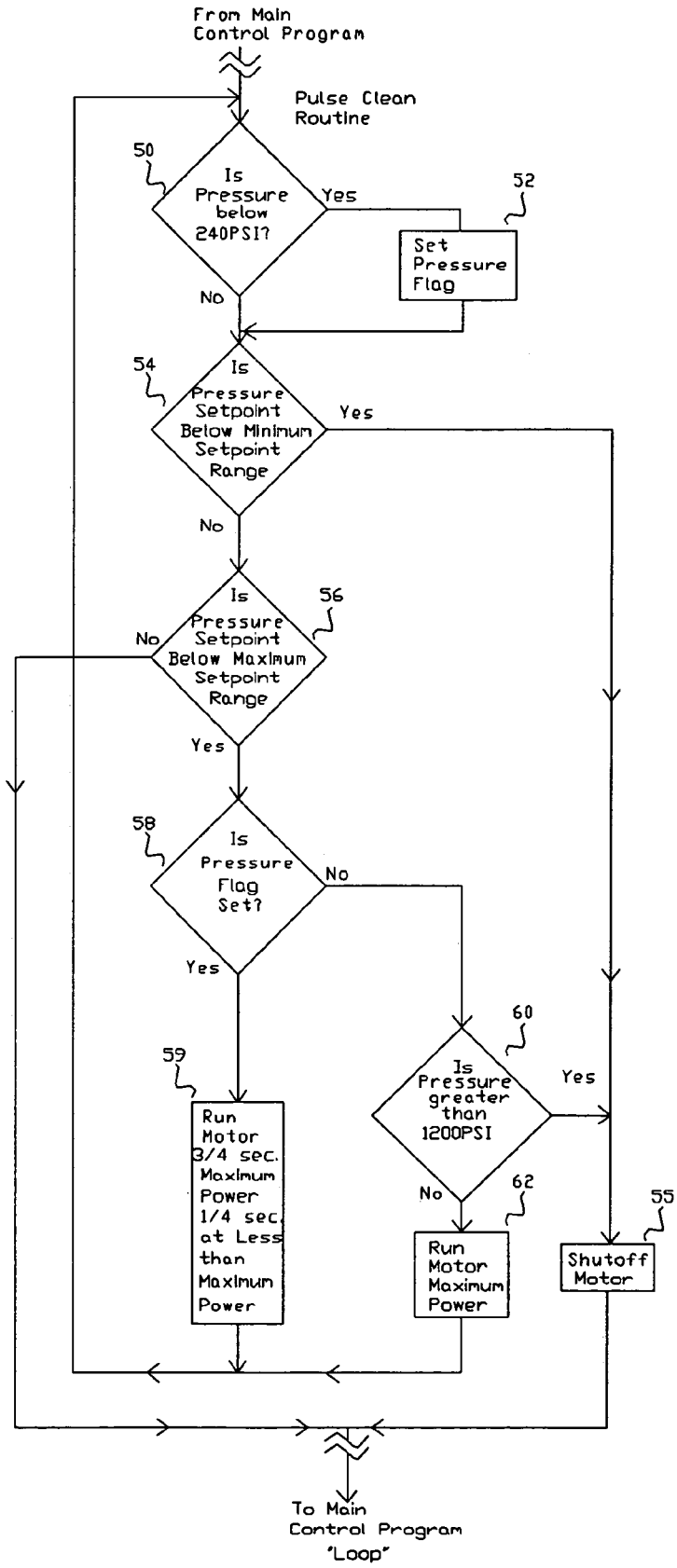
FIG. 3 is a flow chart of a program useful in the practice of the present invention.
Figure 4:
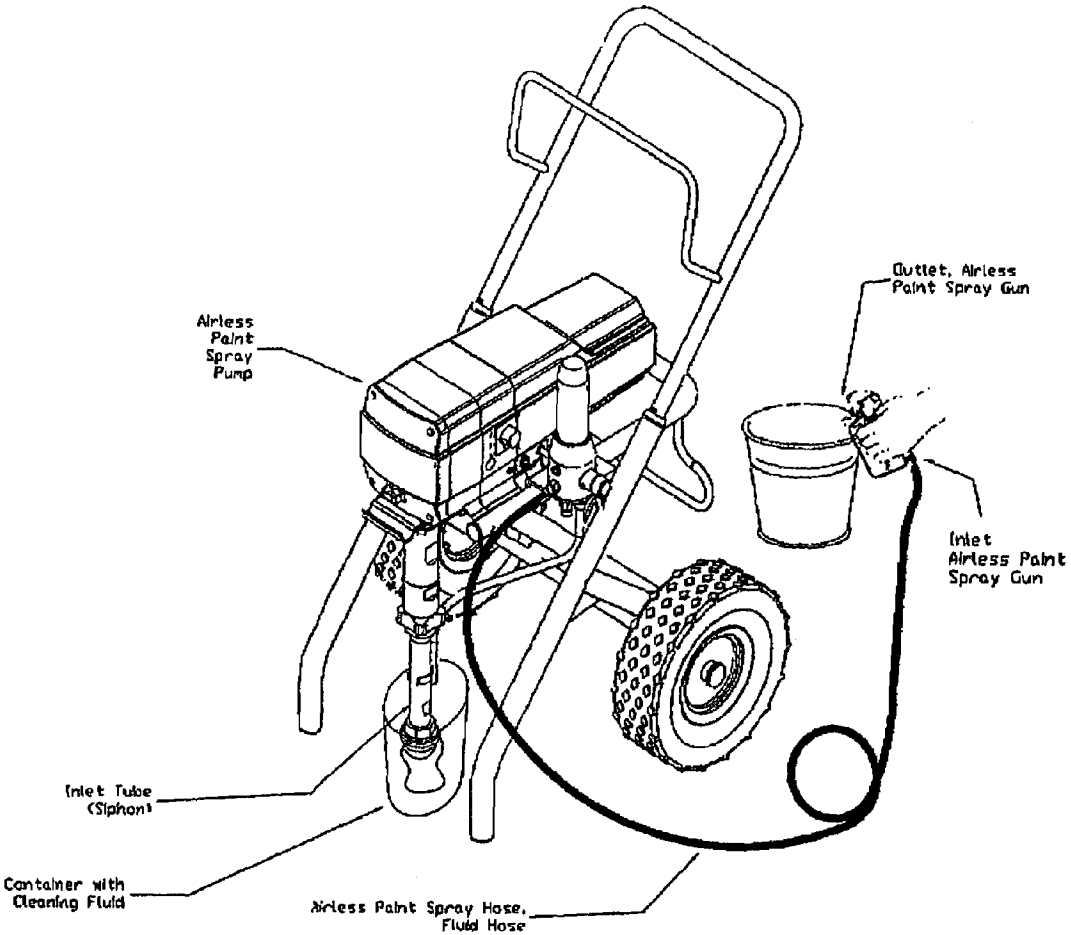
FIG. 4 shows structural features of the system including the paint Spray, the pumn end its inlet/outlet, the fluid hose, the spray gun.

FIG. 3 is an example of a flow chart of the control program useful in the operation of this embodiment of the present invention.

After use or whenever there is a color change, flow problem, or other event, the paint sprayer including pump, fluid hose and spray gun may be cleaned. They are typically cleaned together as a unit with one end of the hose being connected to the pump outlet and the other end of the hose being connected to the gun inlet. The spray tip and guard may be removed from the spray gun for cleaning separately. The pump siphon tube is placed into a container of an appropriate cleaning fluid or solvent, which can be, for example, water for latex paint and mineral spirits for oil-based paints, and the spray gun is placed into a separate waste container. The operator turns the power switch on and adjusts the pressure reference 36 to a desired position in the clean range in order to set the system for cleaning.

At block 50, actual pressure is compared to a first pressure reference point for example, 240 psi. The first pressure reference point is a value (or a value range) corresponding to a pressure that would be developed by the pump if paint, rather than solvent, is being pumped. A Pressure Flag is set at block 52 when the actual pressure is less than the first pressure reference point.

The system then checks whether the pressure reference 36 is set for the cleaning operation. Preferably, there is a designated set-point range of operation for the cleaning position of pressure reference 36 to compensate for tolerance and operator error. At block 54, the system first checks whether the pressure set point is above or below the minimum value of the designated set-point range.

A set point below the range for cleaning indicates a shut-off condition, thereby causing the system to shutoff the motor drive circuit 42, block 55.

When the set point is found to be above the minimum value of the designated range, then at block 56, the system checks whether the set point falls below the maximum value of the range. Once a determination is made that the set point is within the range set for cleaning, the system checks whether the Pressure Flag is set, block 58. If the Pressure Flag is set, the system will begin pulse cleaning by altering, e.g. cycling, the electric power that is applied to the motor 40 to vary the motor speed, e.g., between two different power levels, block 59, and the routine repeats itself until the operator determines that the sprayer is clean and turns the power off. Alternatively, the routine can be arranged to repeat a number of times, then automatic shut off the power. Also, as previously noted, rather than cycling between two different power levels, the power can be altered by stepping between various power settings or by being randomly changed.

It is to be understood that the motor power level can be any value between zero and maximum power level, and that any such power level can be maintained for any duration of time to create changing flow rates or an alternating pattern of different flow rates to produce the desired turbulence or increased turbulence.

If the Pressure Flag is clear after a determination is made that the set point is within the range set for cleaning, actual pressure is measured and compared to a second pressure reference. The second pressure reference, block 60, is a value corresponding to a pressure above which a pressure-related injury can occur. When the actual pressure exceeds the second pressure reference, the system will shutoff the motor drive circuit 42, block 55, and refers back to the main control program. At this point, the operator must perform proper pressure relief procedures as determined by the pump manufacturer before re-starting the system.

A detection of a pressure set point above the maximum value of the set point range, block 56, is referred to the main control program.

When actual pressure exceeds the first pressure reference point, but not the second pressure reference point, block 60, and pressure reference 36 is properly positioned within the designated pressure set-point range for cleaning, the system enables the motor drive circuit 42 to operate motor 40 at maximum power level, block 62. Operation at maximum power level continues until actual pressure falls below the first pressure reference point, block 50, as the pulse clean routine repeats itself Typically, the maximum power level operation will continue until substantially all paint has been pumped out of the paint line.

A useful value of the first pressure reference (blocks 50, 52) is approximately 240 PSI, and a useful value of the second pressure reference (block 60) is approximately 1200 PSI. However, it is to be understood that other values may be used in the practice of the invention.

The following table shows comparative data on cleaning a paint hose using the above-described method of the present invention compared to a prior art technique.

HOSE CLEANOUT TEST

| | Empty Hose | Remove Residual Pain | | Total | |
|---|---|---|---|---|---|
| Operation | Time | Time | Solvent | Time | Solvent |
| Cycled Invention | 16 seconds | 150 seconds | 1.52 gallons | 166 seconds | 1.52 gallons |
| Continuous Prior Art | 15 seconds | 195 seconds | 1.95 gallons | 210 seconds | 1.95 gallons |

Pump: Piston Pump
Media: Latex Paint
Solvent: Water
Cycled Operation: Power Level Full for 0.75 Second, Power Level Off for 0.25 Second As this test shows, the present invention takes less time and uses less solvent to clean a paint hose than a conventional system.

Although the present invention is preferably suitable for positive-displacement pumps, such as a piston pump, it will be understood that the improved cleaning system described herein would apply to other pump types as well.

The above description and drawings are only illustrative of the preferred embodiment of the present invention. The invention is not limited to only those details in the foregoing disclosure as modifications and variations thereof may be made without departing from the spirit and scope of the invention.

The invention claimed is:

1. A method of cleaning a paint sprayer pump from residual paint without the addition of compressed air, the paint sprayer pump being driven by a drive, the method comprising the steps of:

supplying a cleaning fluid adapted to remove residual paint to an inlet of the paint sprayer pump;

predetermining a cleaning pressure range comprising a first and a second flow rate;

setting a desired flow rate of the paint sprayer pump;

verifying that the desired flow rate is in the predetermined cleaning pressure range;

entering a cleaning cycle when the desired flow rate is in the predetermined cleaning pressure range;

operating the paint sprayer pump alternately between the first and the second flow rate to cycle a flow rate of the paint sprayer pump while verifying that a power level of the drive produces a flow rate between the first and the second flow rate of the paint sprayer pump; and pumping the cleaning fluid through the paint sprayer pump to an outlet of the paint sprayer pump while the flow rate is cycling;

wherein the paint sprayer pump produces increased turbulence in the cleaning fluid through an alternating pattern of increasing and decreasing flow rates achieved by the cycling of the power level in the paint sprayer pump cleaning the paint sprayer pump; and further comprising the steps of measuring actual flow rate at an outlet of the paint sprayer pump and setting a pressure flag when the actual flow rate is less than the smaller of the first and second flow rate, and wherein when the pressure flag is set the paint sprayer pump is operated.

2. The method of claim 1, wherein when the pressure flag is not set the paint sprayer pump is operated at the greater of the first and second flow rate.

3. The method of claim 1 wherein the first flow rate is maintained for a first duration of time and the second flow rate is maintained for a second duration of time.

4. The method of claim 1 wherein the first flow rate is maximum power level and the second flow rate is a value less than maximum power level.

5. The method of claim 1 further comprising the step of initiating the step of pumping the cleaning fluid and ten permitting the paint sprayer pump to perform the step of pumping the cleaning fluid unattended.

6. The method of claim 3, wherein the first flow rate is 240 psi.

7. The method of claim 3, wherein the second flow rate is 1200 psi.

8. A method of cleaning a paint sprayer from residual paint without the addition of compressed air, having a paint sprayer pump, a fluid hose, and a spray gun, the paint sprayer pump having an inlet and an outlet with the outlet being connected to one end of the fluid hose, the spray gun having an inlet and an outlet with the inlet being connected to the other end of the fluid hose, the method comprising the steps of:

supplying a cleaning fluid adapted to remove residual paint to the inlet of the paint sprayer pump;

predetermining a cleaning pressure range comprising a first and a second flow rate;

setting a desired flow rate of the paint sprayer pump;

verifying tat the desired flow rate is in the predetermined cleaning pressure range;

entering a cleaning cycle when the desired flow rate is in the predetermined cleaning pressure range;

operating the paint sprayer pump alternately between the first and the second flow rare to cycle a flow rate of the paint sprayer pump while verifying that a power level of the drive produces a flow rate between the first and the second flow rate of the paint sprayer pump; and pumping the cleaning fluid through the paint sprayer pump, fluid hose and spray gun to the outlet of the spray gun while the flow rate is cycling;

wherein the paint sprayer pump produces increased turbulence in the cleaning fluid through an alternating pattern of increasing and decreasing flow rates achieved by the cycling of the power level in the paint sprayer pump cleaning the paint sprayer; and further comprising the steps of measuring an actual flow rate at an outlet of the paint sprayer pump and setting a pressure flag when the actual flow rate is less than the smaller of the first and second flow rate, and wherein when the pressure flag is set the paint sprayer pump is operated.

9. The method of claim 8 further comprising the step of initiating the step of pumping the cleaning fluid and then permitting the paint sprayer pump to perform the step of pumping the cleaning fluid unattended.

10. The method of claim 8 wherein the first flow rate is maintained for a first duration of time and the second power level is maintained for a second duration of time.

11. The method of claim 8 wherein the first flow rate is maximum flow rate and the second flow rate is a value less than maximum flow rate.

12. The method of claim 10, wherein the first flow rate is 240 psi.

13. The method of claim 10, wherein the second flow rate is 1200 psi.

14. A method of operating a paint sprayer pump having a drive to remove residual paint in a paint sprayer without the addition of compressed air, the method comprising the steps of:

supplying a cleaning fluid adapted to remove residual paint to an inlet of the paint sprayer pump;

predetermining a cleaning pressure range comprising a first and a second flow rate;

setting a desired flow rate of the paint sprayer pump;

verifying that the desired flow rate is in the predetermined cleaning pressure range;

entering a cleaning cycle when the desired flow rate is in the predetermined cleaning pressure range;

operating the paint sprayer pump alternately between the first and the second flow rate to cycle a flow rate of the paint sprayer pump while verifying that a power level of the drive produces a flow rate between the first and the second flow rate of the paint sprayer pump; and pumping the cleaning fluid trough the paint sprayer pump to an outlet of the paint sprayer pump while the flow rate is cycling;

wherein the paint sprayer pump produces increased turbulence in the cleaning fluid through an alternating pattern of increasing and decreasing flow rates achieved by the cycling of the power level in the paint sprayer pump cleaning the paint sprayer; and further comprising the steps of measuring an actual flow rate at an outlet of the paint sprayer pump and setting a pressure flag when the actual flow rate is less than the smaller of the first and second flow rate, and wherein when the pressure flag is set the paint sprayer pump is operated.

15. The method of claim 14 further comprising the step of initiating the step of pumping the cleaning fluid and then permitting the paint sprayer pump to perform the step of pumping the cleaning fluid unattended.

16. The method of claim 14 wherein the first flow rate is maintained for a first duration of time and the second flow rate is maintained for a second duration of time.

17. The method of claim 14 wherein the first flow rate is maximum power level and the second flow rate is a value less than maximum power level.

18. The method of claim 17, wherein the first flow rate is 240 psi.

19. The method of claim 17, wherein the second flow rate is 1200 psi.

* * * * *

UNITED STATES PATENT AND TRADEMARK OFFICE

CERTIFICATE OF CORRECTION

PATENT NO. : 7,128,539 B2
APPLICATION NO. : 10/159789
DATED : October 31, 2006
INVENTOR(S) : Troy Allen Anderson et al.

It is certified that error appears in the above-identified patent and that said Letters Patent is hereby corrected as shown below:

Column 1

Line 4, insert attached "BACKGROUND OF THE INVENTION" section

Line 51, delete "DRAWING" and insert -- DRAWINGS --

Line 60, delete "Spray" and insert -- spray --

Line 60, delete "pumn end" and insert -- pump and --

Column 4

Line 5 (line 2 of table), delete "Pain" and insert -- Paint --

Column 5

Line 33, delete "rare" and insert --rate --

Background of the Invention

The present invention relates generally to pumping systems and, more particularly, it relates to an improved cleaning system for paint sprayers wherein the paint sprayer is cycled to produce, for example, a turbulent flow or increased turbulence in the cleaning solvent for enhanced cleaning of the unit.

It is known that when a cleaning fluid flows turbulently the efficiency of the cleaning is increased due to the scrubbing action caused by generated turbulence in the fluid. It is also known that the potential for turbulent flow to occur in the fluid becomes greater as the velocity or flow rate of the fluid increases.

A known cleaning technique used air and solvent pulsed alternately through the fluid-carrying hose or conduit to achieve the desired turbulence in the solvent. Other methods described in U.S. Pat. Nos. 5,699,817 and 5,322,571, for example, passed a pressurized solvent through the conduit with a quantity of compressed air added to the solvent to produce the turbulent mixture.

The traditional method of cleaning a paint sprayer utilizes the sprayer itself operating at maximum speed to pump a solvent through the unit until the solvent comes out clean. Sometimes the operator may trigger the spray gun to pulse the solvent for more effective cleaning.

UNITED STATES PATENT AND TRADEMARK OFFICE

CERTIFICATE OF CORRECTION

PATENT NO. : 7,128,539 B2
APPLICATION NO. : 10/159789
DATED : October 31, 2006
INVENTOR(S) : Troy Allen Anderson et al.

It is certified that error appears in the above-identified patent and that said Letters Patent is hereby corrected as shown below:

In the present invention, the pump itself produce turbulence or increased turbulence in the solvent through an alternating pattern of increasing and decreasing flow rates achieved by cycling or altering the applied power to the motor. There is no need to provide a source of compressed air. Moreover, the operator can walk away from the unit and do something else while the cleaning operation proceeds; there is no need to trigger the gun during cleaning.

Signed and Sealed this

Fourteenth Day of August, 2007

JON W. DUDAS
*Director of the United States Patent and Trademark Office*